US009476212B2

(12) United States Patent
Abbasi et al.

(10) Patent No.: US 9,476,212 B2
(45) Date of Patent: Oct. 25, 2016

(54) SYSTEM AND METHOD FOR STRUCTURAL REHABILITATION AND ENHANCEMENT

(71) Applicants: Seyed Hossein Abbasi, Covnia, CA (US); Neil Javad Abbasi, Pasadena, CA (US)

(72) Inventors: Seyed Hossein Abbasi, Covnia, CA (US); Neil Javad Abbasi, Pasadena, CA (US)

( * ) Notice: Subject to any disclaimer, the term of this patent is extended or adjusted under 35 U.S.C. 154(b) by 0 days.

(21) Appl. No.: 14/735,121

(22) Filed: Jun. 9, 2015

(65) Prior Publication Data

US 2015/0354238 A1 Dec. 10, 2015

Related U.S. Application Data

(60) Provisional application No. 62/010,356, filed on Jun. 10, 2014.

(51) Int. Cl.
*E04G 23/02* (2006.01)
*E04G 23/00* (2006.01)

(52) U.S. Cl.
CPC ..... *E04G 23/0218* (2013.01); *E04G 23/02* (2013.01); *E04G 23/0203* (2013.01); *E04G 23/0266* (2013.01); *E04G 2023/0251* (2013.01)

(58) Field of Classification Search
CPC ..... E04G 23/02; E04G 23/0218; E04G 23/0203; E04G 23/0229; E04G 2023/0251; E04G 23/0266; E04G 23/0288; E04G 23/00
USPC ..... 52/514, 514.5
See application file for complete search history.

(56) References Cited

U.S. PATENT DOCUMENTS 5,063,006 A * 11/1991 Tahara ..... E04G 23/0203 264/35
8,062,699 B2 * 11/2011 Cho ..... C04B 41/009 427/140
8,479,468 B1 7/2013 Abbasi
8,745,957 B2 * 6/2014 Hussain ..... E04G 23/02 52/514
2005/0246995 A1 * 11/2005 Lecinq ..... F16L 9/153 52/514.5
2008/0131594 A1 * 6/2008 Cho ..... C04B 41/009 427/140
2009/0025329 A1 * 1/2009 Morton ..... E04G 23/0203 52/514.5
2015/0167332 A1 * 6/2015 Shiota ..... E04G 23/0218 52/514
2015/0197950 A1 * 7/2015 Lewis ..... E04G 23/0207 52/514.5
2015/0345159 A1 * 12/2015 Yamakawa ..... E04G 23/0218 52/514.5
2015/0354238 A1 * 12/2015 Abbasi ..... E04G 23/0218 52/514.5

FOREIGN PATENT DOCUMENTS

JP 05272245 A * 10/1993

OTHER PUBLICATIONS

Product Data_HCM-25R.
Product-Data_C-Clad_FRP.
Product-Data_FC061_FRP.
Product-Data_GS100_FRP.
Product-Data_RN075_FRP.
Product-Data_SC352_FRP.

* cited by examiner

*Primary Examiner* — Phi A
(74) *Attorney, Agent, or Firm* — Patent Law Agency, LLC; Peter Ganjian

(57) ABSTRACT

The present invention discloses system and method for rehabilitation and enhancement of structural integrity of a reinforced concrete structures, comprising exposing beyond a deteriorated portion of a reinforcement where a non-deteriorated portion is visible, covering a surround of the exposed reinforcement by a tensile member that is coupled with an exterior surface of the reinforced concrete structure, and encapsulating the exposed reinforcement, with the encapsulation formed by the tensile member.

9 Claims, 15 Drawing Sheets

SYSTEM AND METHOD FOR STRUCTURAL REHABILITATION AND ENHANCEMENT

CROSS-REFERENCE TO RELATED APPLICATIONS

This application claims the benefit of priority of U.S. Utility Provisional Patent Application No. 62/010,356, filed 10 Jun. 2014, the entire disclosure of which is expressly incorporated by reference in its entirety herein.

It should be noted that where a definition or use of a term in the incorporated patent application is inconsistent or contrary to the definition of that term provided herein, the definition of that term provided herein applies and the definition of that term in the incorporated patent application does not apply.

BACKGROUND OF THE INVENTION

1. Field of the Invention

One or more embodiments of the present invention relate to cost effective structural rehabilitation and enhancement.

2. Description of Related Art

Structural integrity of reinforced concrete structures is severely compromised due to spalling. In general, spalling is caused due to corrosion of the reinforcement, which is generally a reinforcing bar (or rebar for short) that is a metal or a metallic alloy most likely comprised of steel. When the reinforcement corrodes, it rusts (and crumbles) and therefore, expands in volume within the concrete structure, causing spalling. Additionally, loose pieces of rust particles (or crumbles) of the reinforcement also cause the concrete structure to lose its mechanical bond with the reinforcement, making the reinforcement ineffective. A further issue with corrosion of the reinforcement is that as the reinforcement corrodes into crumbling rust, the amount of reinforcement left is degraded, weakening the structural integrity of the reinforced concrete structure.

Conventional methods for repairing of spalled reinforced concrete structures vary greatly dependent on the amount of spalling of the reinforced concrete structure, the amount of corrosion of the reinforcement, and overall budgeted cost for repair. In general, the conventional repairing processes of spalled reinforced concrete structures involved many labor-intensive steps that are complex and require skilled labor, which adds to the overall cost of the structural rehabilitation.

In general, conventional methods of repair require excavation of the concrete structure to reach the corroded rebar. It should be noted that the size of the excavation (the cavity) should be sufficiently large to expose rebar beyond the corroded portion. That is, the excavation size should be large to reach the portion of the rebar where no corrosion is observed. Additionally, if the extent of the corrosion of the rebar observed is severe (e.g., where the integrity of the rebar is fully compromised, making it ineffective), the cavity should be further extended axially along the rebar to expose even more of the non-corroded portion thereof to enable augmentation of the rebar using well known splicing methodologies (detailed below).

Once the appropriate axial length of rebar is fully exposed, the formed cavity is cleaned from debris such as loose concrete. Further, the rebar is also completely cleaned from debris, loose rust, and any visible corrosion. That is, the rebar must be completely cleaned from any corrosion until a non-corroded portion of the rebar (the actually clean, bare steel portion) is reached. Therefore, to completely clean the rebar from rust or any corrosion, excavated cavity must also be of sufficient depth to enable access and reach to the entire surface of the exposed rebar from all directions and not just the "front" viewable portion. It should be noted that completely cleaning of the rebar from corrosion and removal of all rust (e.g., by scraping) is very time consuming and labor intensive. If the rebar is fully compromised, the compromised portion must be cut out completely and augmented.

The augmentation of a rebar is a complex, labor intensive, and time-consuming process that uses well known splicing methodologies, resulting in a lap spliced rebar. In general, the conventional methods for augmentation of a rebar require that the fully compromised portion of the rebar to be cut-off, and the remaining non-corroded exposed portions thereof be of sufficient axial length to allow for splicing (e.g., lap splicing). Therefore, the cavity itself must be enlarged to expose sufficient axial length of the non-corroded portion of the rebar to allow for proper lap splicing, resulting in continuous line of reinforcement that meet the required tensile strengths.

After cleaning the rebar and cavity from loose debris (rust or loose concrete), and if required, augmenting the rebar, corrosion protection (anti-corrosion) is applied to the rebar (and the augmented rebar). Thereafter, a primer (sealant/adhesive bonding material) is applied to the surface of the excavated cavity to seal and provide a bonding surface, which facilitates bonding of mortar (detailed below) with the surface of the cavity.

Thereafter, various methods are used to actually close off the cavity. For conventional methods, if the cavity is small, it is generally more cost effective to patch the cavity using well-known methodologies such as multi-lift patching, which itself is very time consuming, especially if the number of repairs is large. The quality of multi-lift patching process is generally poor due to potentially weak bonding properties between patched layers. Weak bonding properties are generally caused by variations in densities of the patching layers, temperature variation between a patched layer and a next layer, moisture variations, which affect viscosity of subsequent layers, etc.

In conventional methods, if the cavity is large, it is generally more cost effective to pour mortar into a larger excavated cavity to close off the exposed rehabilitated rebar. However, prior to pouring of the mortar, forming structures are used for forming the poured mortar to fill the excavated cavity and allow the mortar to be cured flush with exterior surface of the concrete structure, which requires time and materials to construct.

In general, the forming structures used to form (or shape) the mortar are comprised of structures that are built to fit over and cover the excavated cavity. Accordingly, if the forming structure is comprised of wood for example, the appropriate thickness and size of wood must first be selected. Thickness and size depend on the amount of load to be supported by the forming structure. In addition to selecting the correct thickness and size, the actual wooden forming structure constituting the wood form itself must be engineered and built to enable the correct forming or shaping of the mortar. This is especially difficult for non-flat surfaces such as reinforced concrete support columns that are generally cylindrical and hence, the wood forming structure must somehow be built to enable the mortar to be flush with the surface of the cylindrically or other odd-shaped structures.

After selection of the thickness, size, and building of the forming structure, a means must be devised to actually securely position and place the wooden forming structure over the cavity opening. This phase of the overall conventional rehabilitations process becomes complex if the opening is oriented at a direction where the forming structure must be secured against gravity. For example, the excavated cavity opening may be under a bridge where the opening faces "down" below the bridge or it may be vertically oriented at the side of support column. Accordingly, the process of securing the forming structure over the opening must account for supporting it in a secure position. As importantly, the securing means must also support the loads of both the forming structure and the mortar when poured within the cavity (detailed below). Therefore, the securing means must take the weight of the mortar in addition to the forming structure to support both.

Conventional methods of mounting and positioning forming structures depend on the type of material from which the forming structure is made (e.g., wood, steel, plastic, etc.). Normally, setting up a forming structure on a vertical or overhead surface requires support and mechanisms that include intricate bracing, wales, studs, stakes, pegs, screws, clamp supports, bars, etc. The work usually requires tying various pieces together, as well.

After designing a forming structure for the cavity and installing or mounting it to cover over the cavity, a hole is made on the forming structure itself to allow mortar to be poured within the excavated cavity via the hole. This phase becomes complex when the opening of cavity and or the hole is overhead (i.e., oriented such that the pour is against the gravity). Thereafter, there is a wait time until the mortar is cured after which, the forming structure must be removed. The removal of the forming structure is not a simple task as it may require heavy machinery and skilled labor.

It should be noted that in addition to the numerous labor-intensive operations to rehabilitate the reinforced concrete structure, additional care must be taken to ensure compatibility between materials used when rehabilitating the structure. For example, the type of corrosion protection material applied must be compatible with the type of mortar material used to fill the cavity or the type of primer used on the surface of the cavity. For example, the corrosion protection material used should not chemically interact with the mortar material, which may result in a degraded the integrity of both.

Accordingly, in light of the current state of the art and the drawbacks to current rehabilitation methods mentioned above, a need exists for a rehabilitation process that is much simpler, requires much less labor-intensive/skilled operations, and uses compatible material for most rehabilitation projects.

BRIEF SUMMARY OF THE INVENTION

A non-limiting, exemplary aspect of an embodiment of the present invention provides a method for rehabilitation and enhancement of structural integrity of a reinforced structures, comprising:

exposing beyond a deteriorated portion of a reinforcement where a non-deteriorated portion is visible;

covering a surround of the exposed reinforcement by a tensile member that is coupled with an exterior surface of the reinforced concrete structure; and encapsulating the exposed reinforcement, with the encapsulation formed by the tensile member.

Another non-limiting, exemplary aspect of an embodiment of the present invention provides a system for rehabilitation and enhancement of structural integrity of a reinforced structures, comprising:

a tensile member that functions as a forming structure for forming a filler within a substrate;

the filler encapsulates a deteriorated reinforcement, binds to all surfaces with which the filler contacts, and provides compressive strength for the reinforced structure while the tensile member provides a tensile strength.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

Figure 1:
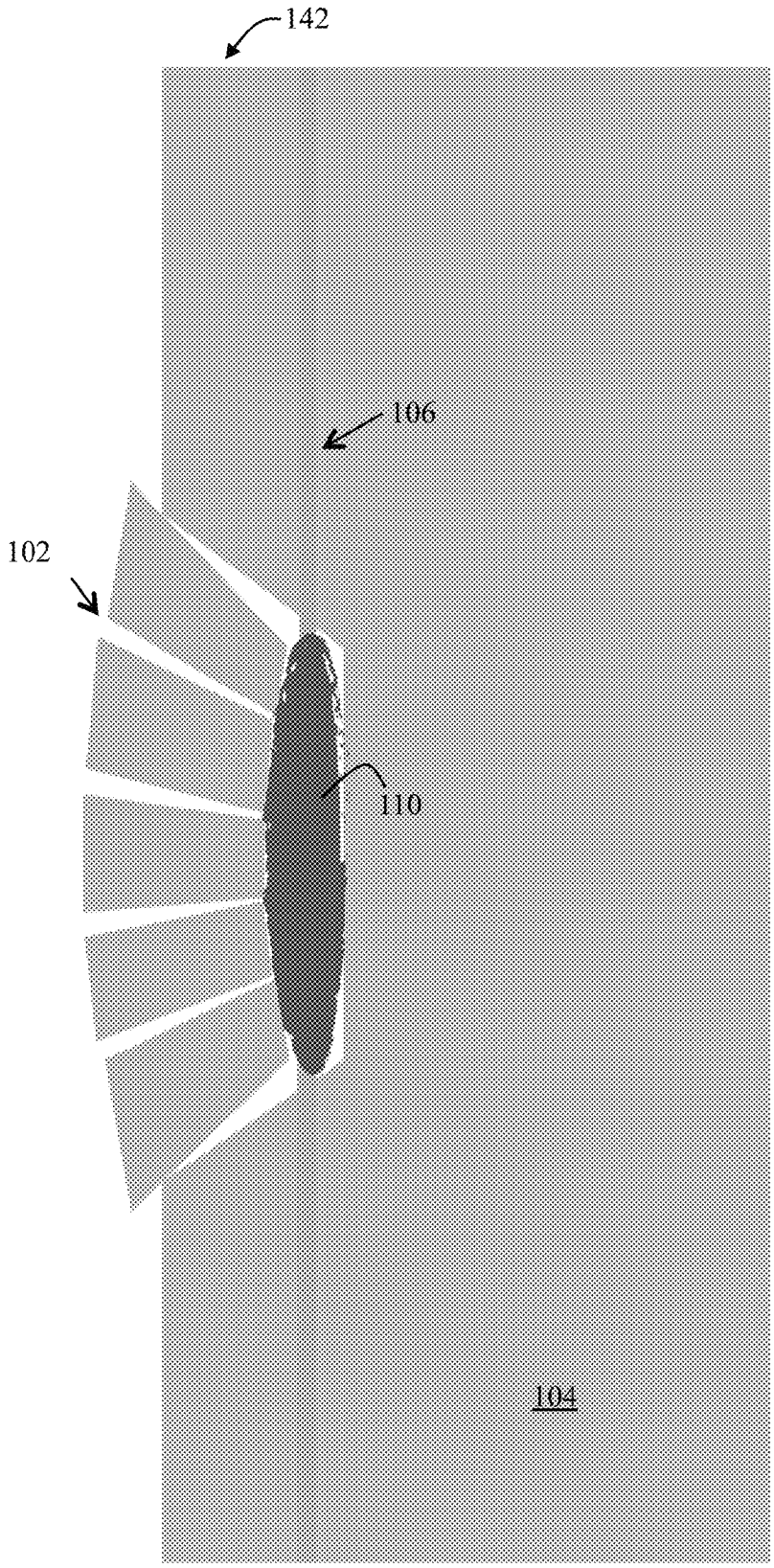
FIG. 1 is non-limiting, exemplary illustration of a reinforced concrete structure with deteriorating reinforcement that is exhibiting spalling.

The detailed description set forth below in connection with the appended drawings is intended as a description of presently preferred embodiments of the invention and is not intended to represent the only forms in which the present invention may be constructed and or utilized.

It is to be appreciated that certain features of the invention, which may, for clarity, be described in the context of separate embodiments, may also be provided in combination in a single embodiment. Conversely, various features of the invention that may, for brevity, be described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they may be described, but instead can be applied, alone or in various combinations, to one or more of the other embodiments of the invention.

One or more embodiments of the present invention provide method and system of rehabilitation processes for reinforced concrete structures that are much simpler, require much less labor-intensive/skilled operations, and use compatible materials for most rehabilitation projects. Non-limiting examples of reinforced concrete structures may include reinforced concrete structural members such as walls, slabs, beams, columns, etc. at various orientations (e.g., vertical, horizontal, inclined, etc.).

One or more embodiments of the present invention provide method and system that simplify repairs and enhance structural integrity of reinforced concrete structures that have compromised tensile and compressive strengths. Compromised or loss of tensile strength of reinforced concrete structure may be generally due to compromised or deteriorated reinforcement because of corrosion. Further, the deterioration of the reinforcement due to corrosion may lead to delaminated and or spalling of the reinforced concrete structures, leading to weakening of compressive strength.

One or more embodiments of the present invention provide method and system for strengthening and enhancement of a structure based on a combination of composite laminate forms constructed of a fiber reinforced polymer composite laminate and a corrosion resistant mortar. The strengthening and enhancement provided by the method and system of the one or more embodiments of the present invention include reinforcements that are less invasive than conventional reinforcement systems such as augmentation, replacement, splicing, or welding of reinforcing steel, or dowelling, at a fraction of complexity, space, and time taken to implement conventional systems.

The repair system in accordance with one or more embodiments of the present invention includes preferred use of a pre-cured fiber reinforced polymer (FRP) laminate bonded by adhesive paste on a prepared surface surrounding a cavity created from removing rust, dust, and loose pieces of concrete resulting from corrosion/rusting of the reinforcement inside the structure. The repair method and system also includes the use of waterproof and generally chemical resistant polymer mortar introduced inside the cavity directly through a port/hole made in FRP laminate after it is fixed to a surface, to completely fill up the cavity and encapsulate the exposed reinforcement, including the corroded portion. The FRP laminate replaces or enhances missing/compromised tensile strength component of reinforced concrete structure and filler enhances compressive and tensile strength components thereof, including providing corrosion protection for the reinforcement.

Figure 7A:
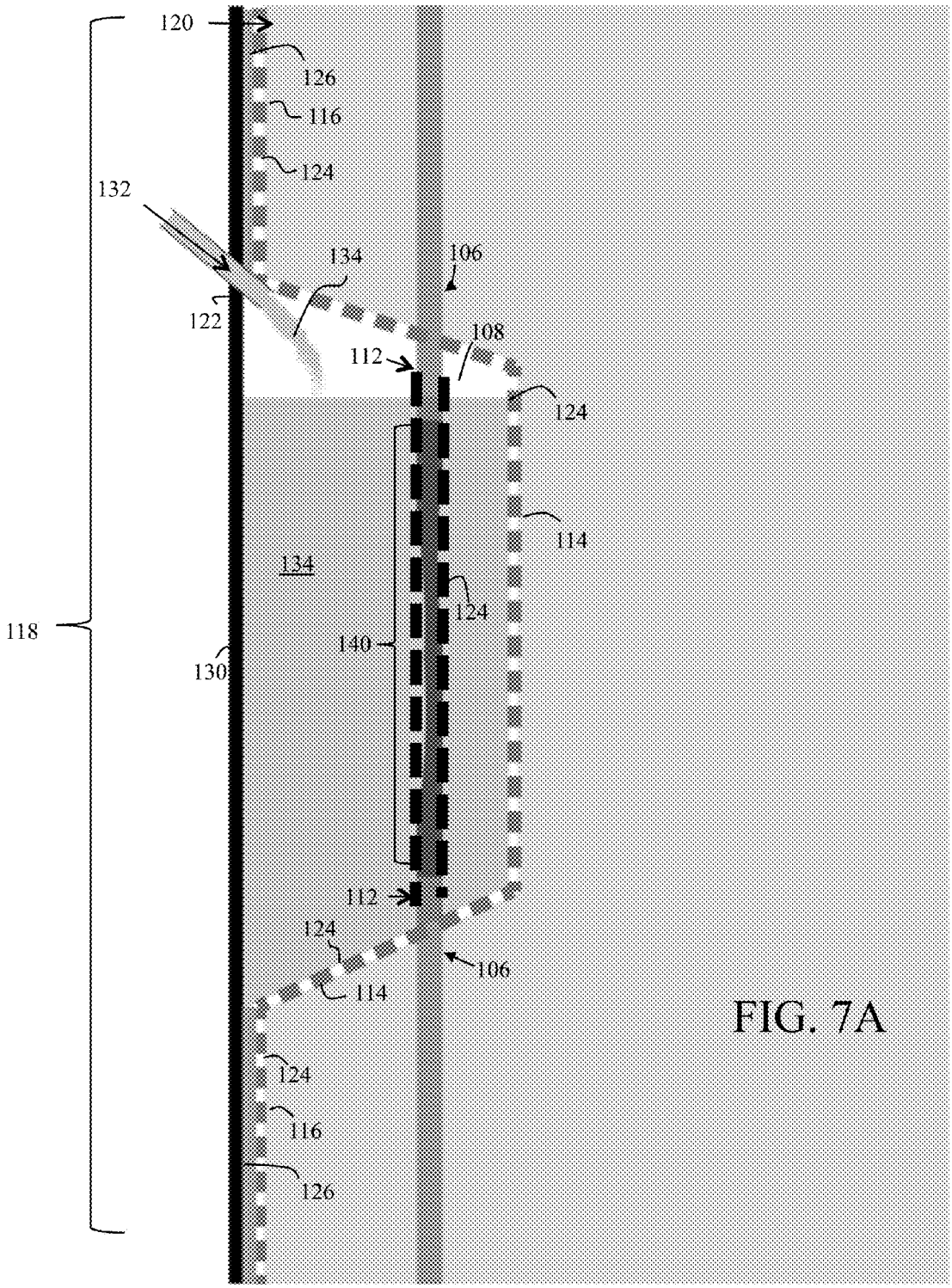
FIGS. 7A to 7C are non-limiting, exemplary illustration of vertically oriented substrate filled with filler in accordance with one or more embodiments of the present invention.
Figure 7B:
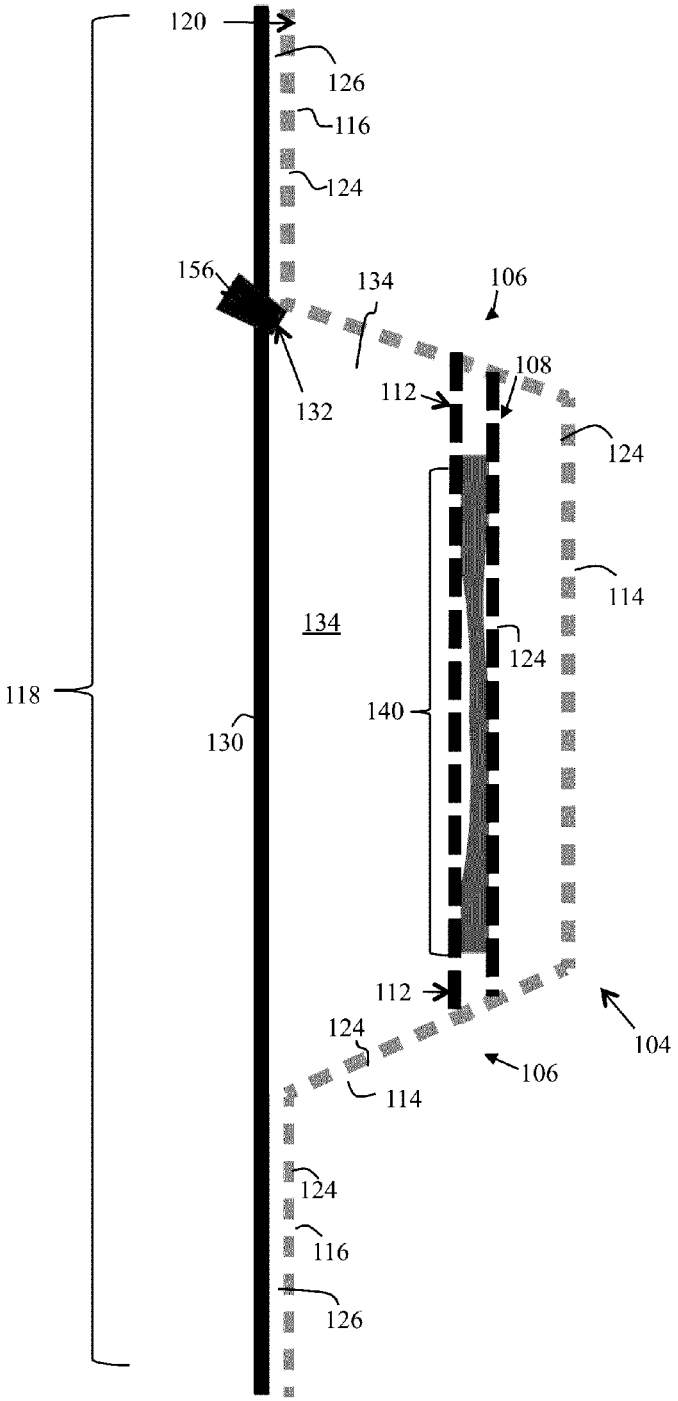
Figure 7C:
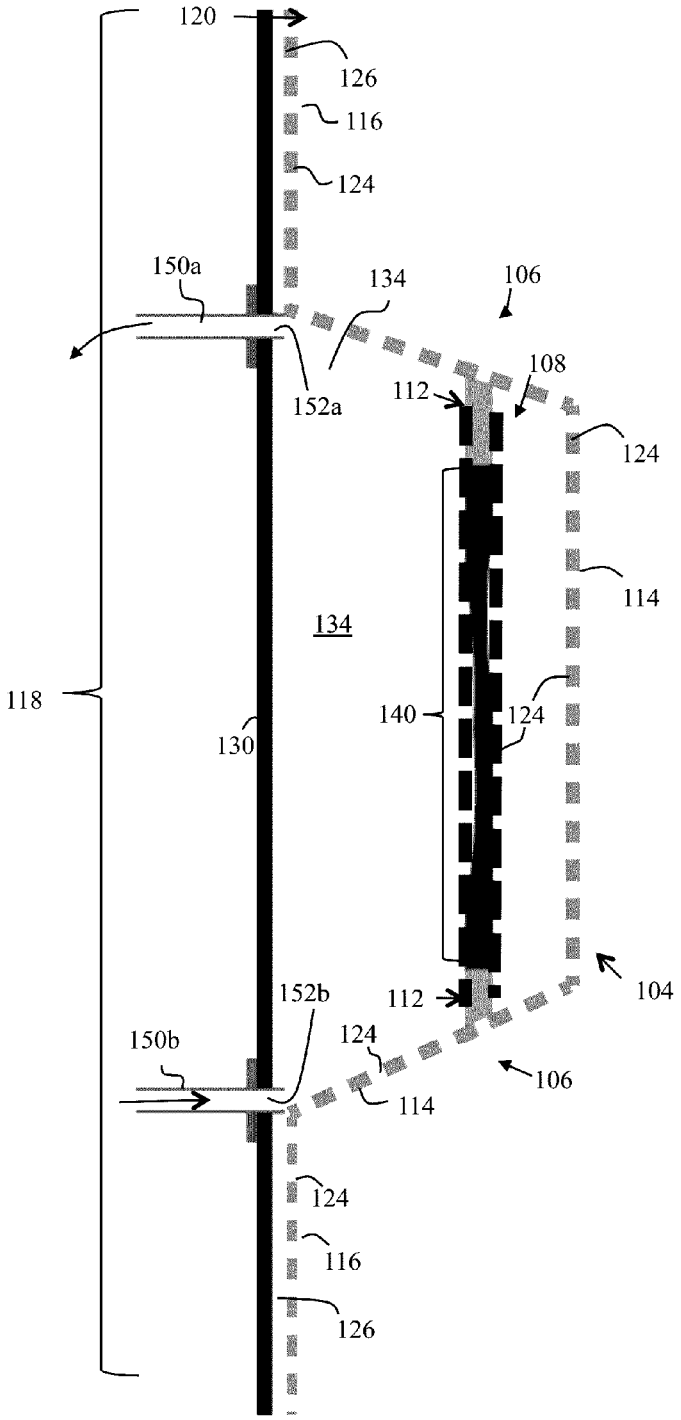
Figure 8A:
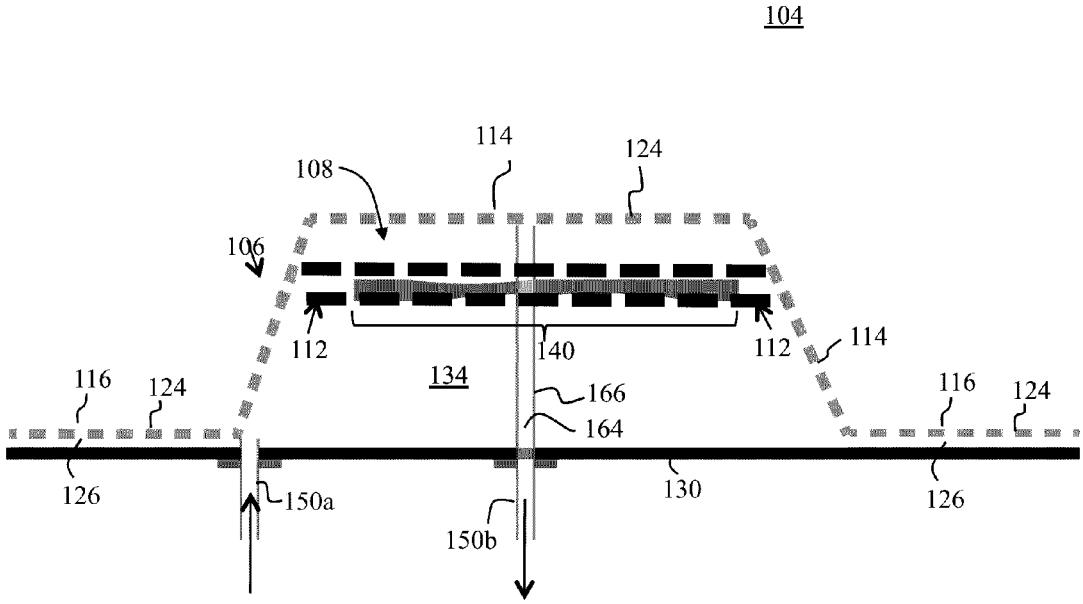
FIGS. 8A and 8B are non-limiting, exemplary illustration of overheard substrate filled with filler in accordance with one or more embodiments of the present invention.
Figure 8B:
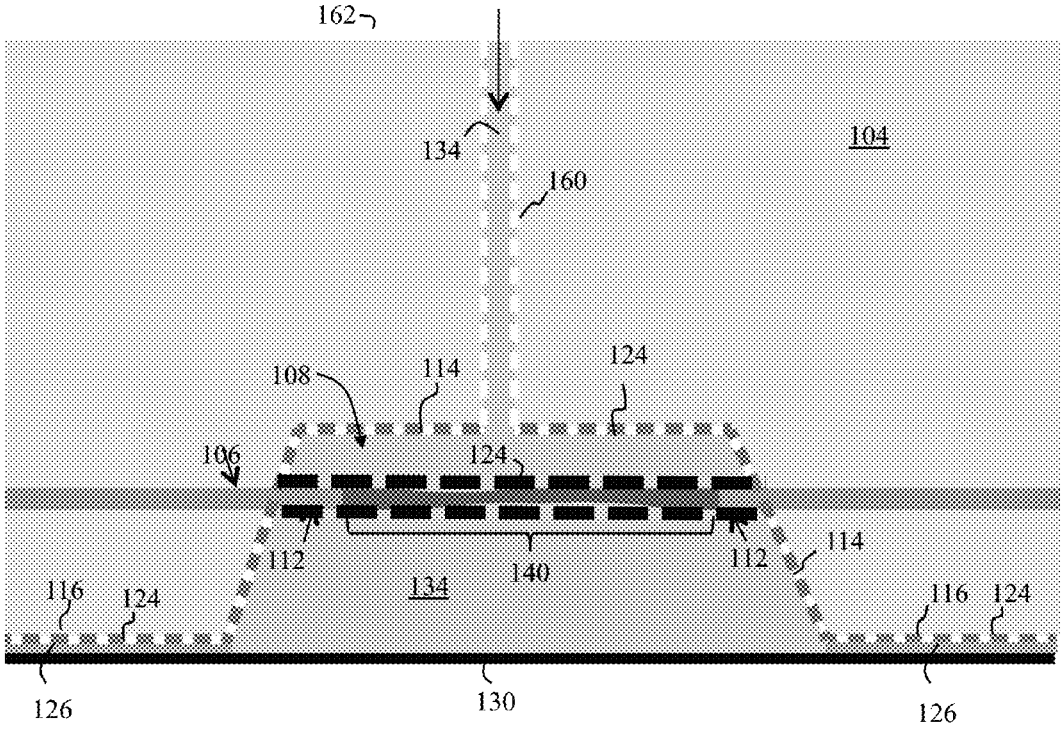

FIGS. 1 to 8B are non-limiting, exemplary illustrations of method and system for structural rehabilitation and enhancement of structural integrity of a reinforced concrete structure, and progressively illustrate a non-limiting, exemplary method of systematic rehabilitation and enhancement operations in accordance with one or more embodiments of the present invention. In particular, FIG. 1 is non-limiting, exemplary illustration of a reinforced concrete structure with deteriorating reinforcement that is exhibiting spalling, and FIGS. 7, 8A and 8B are a non-limiting, exemplary illustration of a fully rehabilitated structure with an enhanced structural integrity in accordance with one or more embodiments of the present invention.

Figure 2:
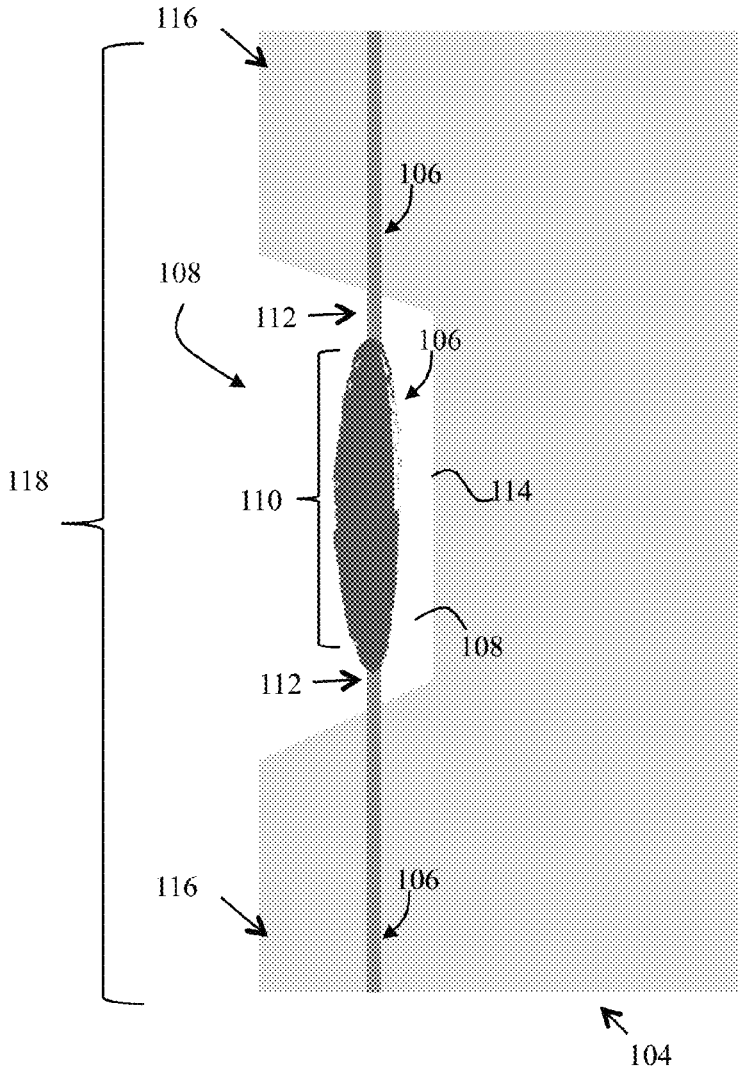
FIG. 2 is non-limiting, exemplary illustration of a substrate of the reinforced concrete structure with exposed reinforcement in accordance with one or more embodiments of the present invention.

As illustrated in FIG. 1, a method for rehabilitation and enhancement of structural integrity of a reinforced concrete structures commences with detecting a blemished surface 102 (e.g., spalling) of the reinforced concrete structure 104, which as indicated above, may be a result of a corroded and rusting reinforcement 106. As best illustrated in FIG. 2, to rehabilitate and enhance the structural integrity of a spalling reinforced concrete structures 104, blemished surface 102 must be excavated until reinforcement 106 is reached. That is, method for rehabilitation and enhancement of structural integrity of reinforced concrete structures 104 includes excavating a portion of the reinforced concrete structure 104 at the blemished surface 102 to reach reinforcement 106 of the reinforced concrete structure 104, with the excavation forming a cavity 108 on the reinforced concrete structure 104.

As illustrated in FIG. 2, cavity 108 may have sufficient size wherein the reinforcement 106 is exposed from all sides as illustrated and further, the exposed and visible portions of reinforcement 106 includes at least a deteriorated portion 110 of reinforcement 106 and a non-deteriorated portions 112. Well-known and conventional mechanical means such as chisel, grinder, hammer, wire brush, etc. may be used to remove all debris and lose pieces of concrete from cavity 108 to reach a sound surface 114 thereof (e.g., a solid surface with no loose particles). All surfaces 114 of cavity 108 may be cleaned from oil, grease, dust, residue, paint, and any other material not part of the substrate 118.

Figure 3A:
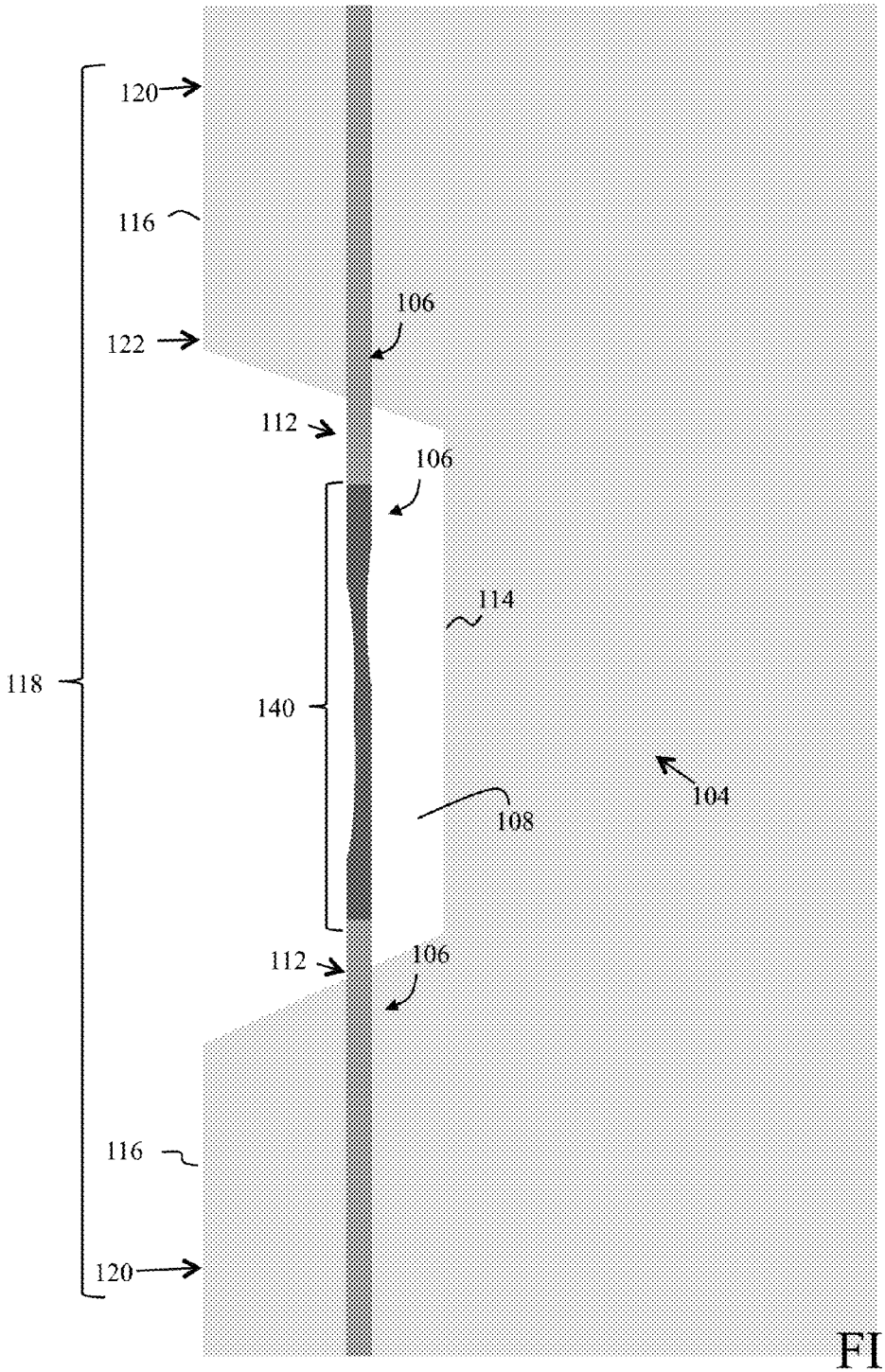
FIG. 3A is non-limiting, exemplary illustration of a substrate with exposed reinforcement and cavity prepared in accordance with one or more embodiments of the present invention.

As best illustrated in FIG. 3A, once exposed, reinforcement 106 is preferably cleaned by removing the loosely corroded portions thereof using conventional mechanical abrasions. It should be noted that cleaning reinforcement 106 from corrosions is optional and is not required. However, as detailed below, cleaning reinforcement 106 from loosely corroded portions (for example, loose and crumbling rust) is required and would further enhance the overall compressive strength of the rehabilitated reinforced concrete structure in accordance with one or more embodiments of the present invention. That is, in general, loose, crumbling rust may potentially lower the overall compressive strength of filler that would be encapsulating the remaining reinforcement 106 (detailed below), if crumbling rust is not removed. In other words, the filler would be encapsulating loose, crumbling rust rather than the clean reinforcement 106, with the crumbling rust positioned between filler and reinforcement 106, which would obviously lower compressive strength of the filler in relation to the remaining reinforcement. It should be noted that although loose, crumbling rust is removed, unlike conventional methods, it is generally preferred to only remove the crumbling, dusty rust of the reinforcement and need not remove all visible corrosion. This substantially reduces time and labor to clean the reinforcement 106 compared with time and labor required using conventional methods described above, where cleaning reinforcement 106 was required to a point where non-corroded, clean reinforcement steel is reached. Further as detailed below, with one or more embodiments of the present invention, there is no need or requirement to apply anti-corrosion to the reinforcement 106 because the filler used (detailed below) is waterproof and fully encapsulates the reinforcement 106, isolating it from potential moisture penetrations and further corrosions.

In general, it is also preferred that cavity 108 and face area 116 be also cleaned from dust and loose particles. Dimensions of face area 116 are dictated by the dimensions of FRP laminate form required and used (as detailed below). To improve adhesion of Fiber reinforced Polymer (FRP) onto face area 116 as detailed below, surface defects of face area 116 may be reduced by reducing surface profile thereof to a maximum of about ⅛ inch or less (depending on application). Stated otherwise, visible protuberances in face area 116 may be smoothed by mechanical abrasion, and visible concave defects may be filled (or patched) with a material that has physical characteristics at least equal to that of substrate 118. Other residues, oils, grease, coatings, sealers, and other contaminants may also be cleaned and if necessary, oil contamination may be removed using a degreaser, and the surface should in general be afterwards thoroughly rinsed free of degreaser and other chemicals such as etching material.

After a thorough preparation of substrate 118, an FRP laminate form may be selected with appropriate shape and dimensions (thickness, length, width) corresponding to the extent and geometry of the spalled area as well as size, spacing, and loss of strength of the reinforcement. That is, size of reinforcement 106 and the extent of loss of reinforcement 106 at portion 140 due to corrosion may be determined to determine correct dimensions and strength properties required for FRP laminate form, which would be used to determine the minimum size of face area 116 required. In general, the FRP laminate form must at minimum cover over the entire cavity 108 and also the entire face area 116 (which may be flat, curved, or other configurations) to provide sufficient strength to replace or supplement the amount of strength of reinforcement 106 lost due to corrosion, and also ensure to maintain filler within cavity. Accordingly, once the extent of loss of tensile strength of reinforcement 106 is determined, the appropriate FRP laminate form, including correct dimensions required to supplement or replace any tensile loss is selected and thereafter, based on the determined FRP laminate form dimensions, size of the face area 116 is determined. It should be noted that as is well known, the fibers of the FRP laminate form used must be oriented parallel to the tensile strength provided (or that would have been provided) by the reinforcement (unidirectional or multidirectional).

As further illustrated in FIG. 3A and as part of continued preparation of substrate 118, once cavity 108 is cleared, boundaries 120 for mounting and installation position of the FRP laminate form may be visibly marked on face areas 116. Further, since cavity 108 would be covered by FRP laminate form prior to filling cavity 108 with the appropriate filler (detailed below), an additional marking 122 may be provided for one or more fill-point openings or holes (detailed below).

Figure 3B:
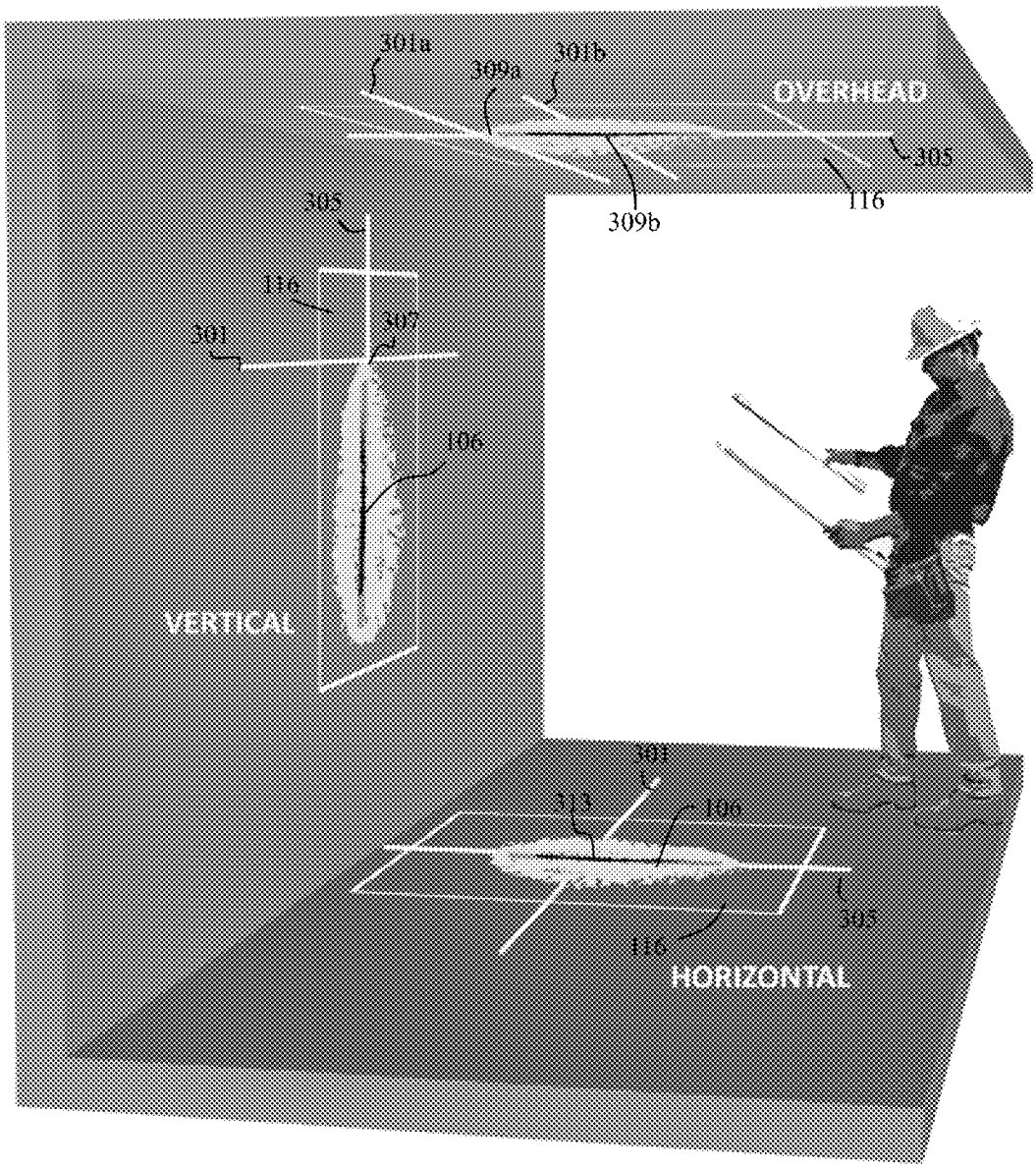
FIG. 3B is a non-limiting, exemplary illustration of various marking methods for proper rehabilitation of reinforce concrete structure in accordance with one or more embodiments of the present invention.

As illustrated in FIG. 3B, if face area 116 is horizontal and facing up, two perpendicular lines 301 and 305 may be drawn on the outside of the area that includes the cavity 108 and face area 116. The lines 301 and 305 should be drawn in a manner that the intersection 313 of their traces is located generally over the deepest part of cavity 108. If face area 116 is vertical or nearly vertical, crosswise lines 301 and 305 may be drawn outside of the area that includes cavity 108 and face area 116 such that the intersection of their traces 301 and 308 points to a spot immediately above a top extreme 307 of cavity 108. If face area 116 is overhead and facing down, a first line 305 is drawn passing through one end of cavity of 108 and a projection of the deepest point of the cavity 108 onto plane of face area 116, which (line 305) may be extended outside the face area 116. Thereafter, a pair of crosswise lines 301*a* and 301*b* may be drawn on the outside of the area that includes cavity 108 and face area 116 such that an intersection 309*a* of the lines 305 and 301*a* points to a spot immediately under an end of cavity 108. Further, the intersection 309*b* (of lines 305 and 301*b*) points to a spot immediately under the deepest point of cavity 108 (providing a crosshair for the projected deepest point). If a reinforcement component happens to lie directly between the intersection 309*b* and the deepest point of cavity 108, the line 305 is redrawn to connect the end of cavity and a point over the deepest part of the cavity 108 and slightly away from of the rebar, so that the new path between intersection 309*b* and the deepest part of the cavity 108 is clear of any rebar. Alternatively, the original set of lines may be kept unchanged and the insertion point is marked and drilled slightly away from the side of the line 305 and long the line 301*b* so that the path between the insertion point and the deepest part of the cavity 108 is clear of any rebar obstruction.

Figure 4:
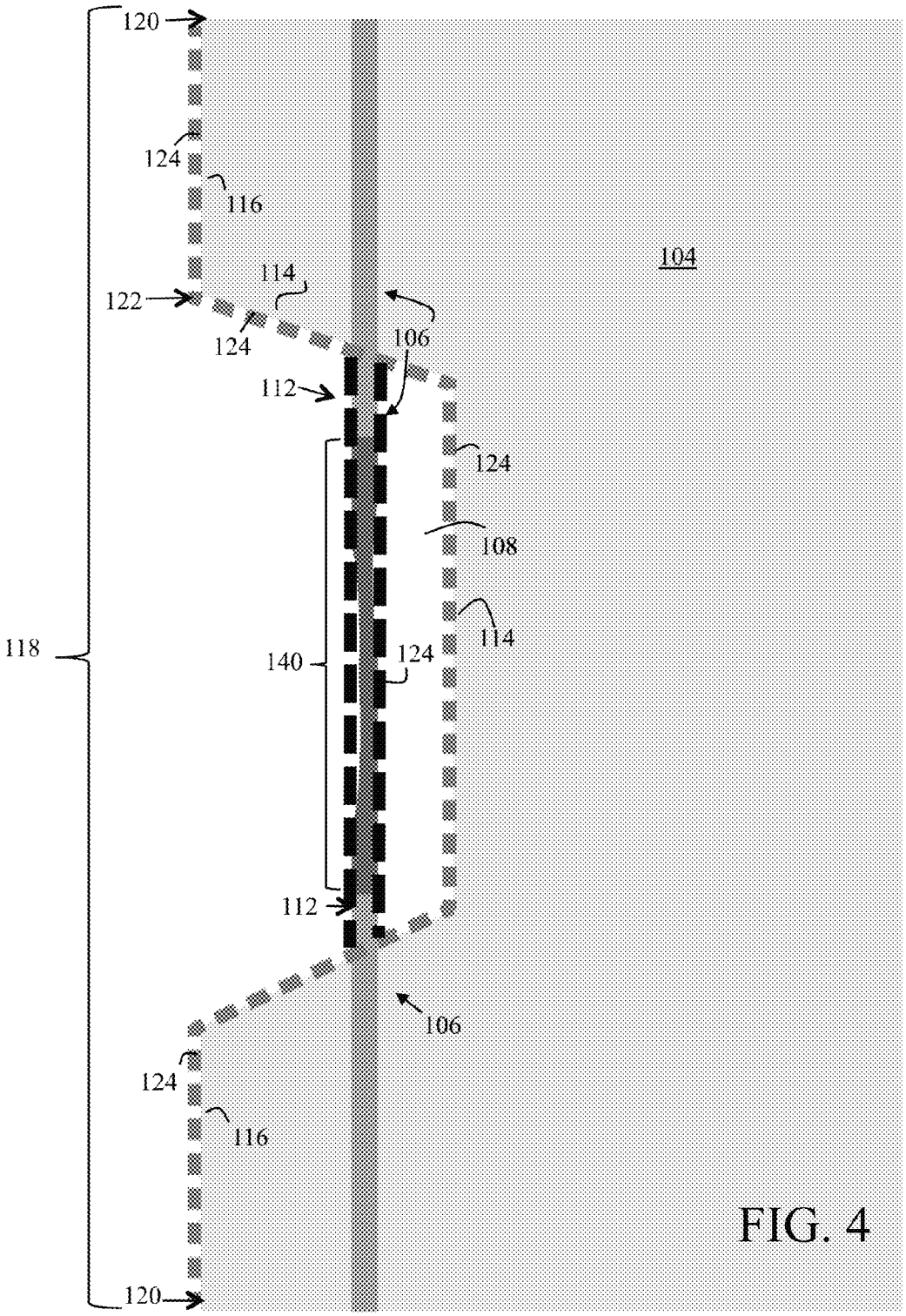
FIG. 4 is a non-limiting, exemplary illustration of substrate with an applied primer in accordance with one or more embodiments of the present invention.

After preparing substrate 118 and as best illustrated in FIG. 4, a primer 124 is applied to coat the entire surface 114 inside cavity 108, including the entire exposed portion of the reinforcement 106 and also the face area 116. Primer 124 provides and enhances bonding between filler (detailed below) and cavity surface 114, and also, reinforcement 106. In addition, since the same primer 124 is used to prepare the adhesive material 126 (detailed below), application of primer 124 to face area 116 would further enhance bonding properties of the FRP laminate form with face area 116. It should be noted that (as detailed below), given that filler itself has bonding capability and would fully pack inside cavity 108 and completely encapsulate reinforcement 106, priming may not be necessary. However, since reinforcement 106 is inside cavity 108 and near surface 114, it would not be disadvantageous to prime cavity 108, reinforcement 106, and surface area 116, which would simply enhance bonding of the filler with all surfaces with which it contacts and encapsulates.

Primer 124 is a polymer that may be an epoxy resin comprised of well known thermosetting polymers, non-limiting, non-exhaustive listing of examples of which may include primer RN075 epoxy system from FRP SOLUTION, INC., or the like. The polymer primer 124 may also optionally be polyurethane or polyester based and need not be epoxy-based resin. In general, primer 124 used should be able to bind to surface 114 with sufficient strength that when cured, primer 124 cannot be mechanically separated from surface 114 without causing cohesive or other damages to the surface 114. That is, mechanically removal of primer 124 will induce or cause cohesive failure on the surface 114. Cured primer 124 should be solid, chemically inert, and impervious to water. Primer 124 should also be sufficiently strong to not peel, crack, wrinkle, shrink or undergo any other deformation due to movements, contractions, expansions or other thermal or mechanical effects that are generally accepted as "normal" for surface 114. Primer 124 should be sufficiently viscous to allow for it to be conveniently applied as a liquid without dripping or sagging down surface 114 after application. In other words, primer 124 has a sufficiently low viscosity to allow primer 124 to coat every surface (and groove, pores, or cracks) of the surface 114, but unlike water, it has sufficiently high viscosity to allow it to remain within the cavity 108. It should be noted that primer 124 is fully compatible with other materials that are used. In fact, primer 124 is the same binder material that is used in making the filler (detailed below) for the cavity 108, FRP laminate forms, and the paste adhesive (detailed below).

Primer 124 may be applied at a rate that it may coat the entire surface 114 uniformly and without blushing. Primer 124 may be applied by spraying or with roller/brush made of solid materials that are inert to primer 124. Afterwards, there is a wait time until primer 124 is not fluid but still tacky before moving to the next operations, which includes operations related to installing the FRP laminate form.

Figure 5:
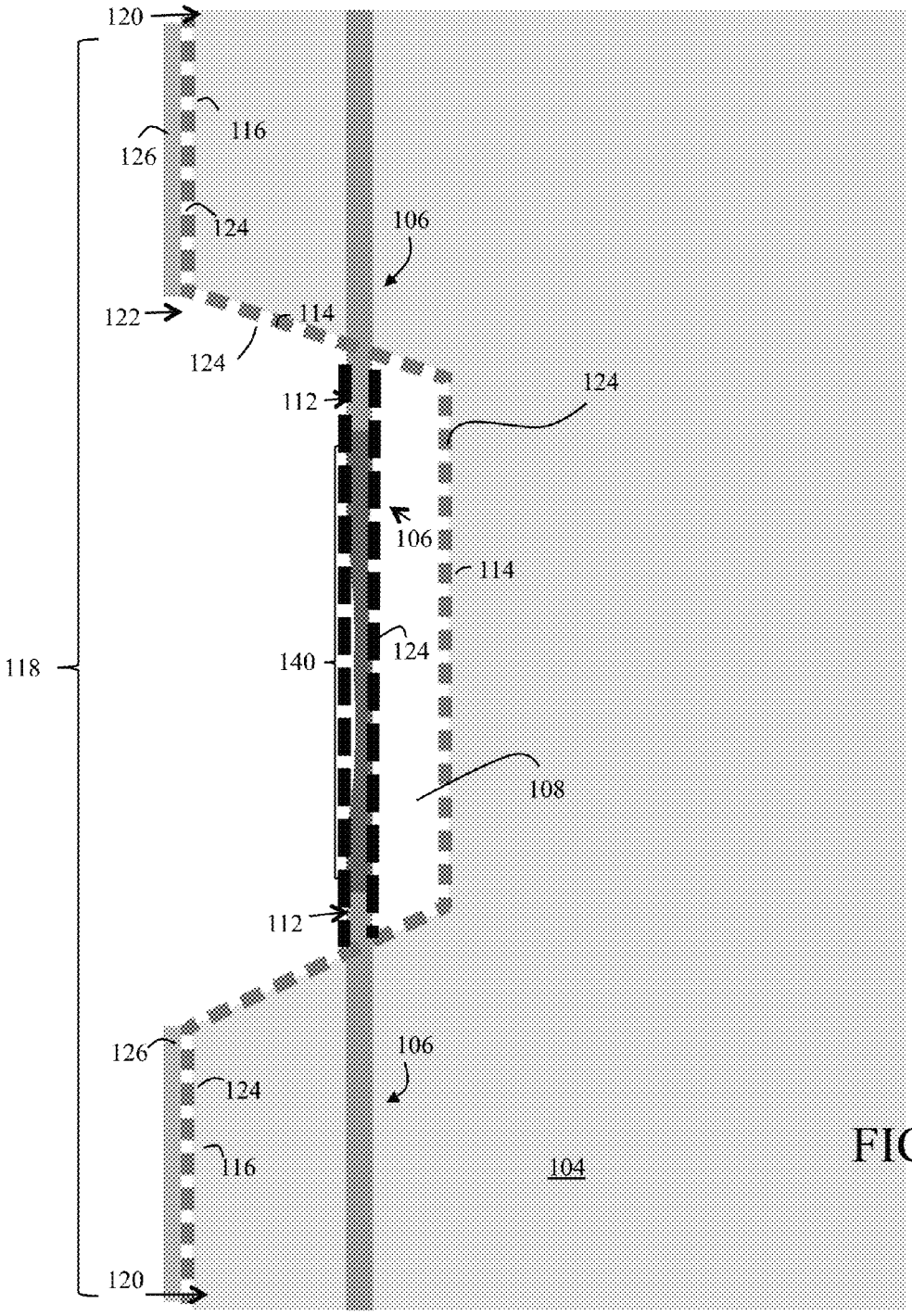
FIG. 5 is a non-limiting, exemplary illustration of substrate with an applied primer and adhesive material in accordance with one or more embodiments of the present invention.

As illustrated in FIG. 5, as part of the installation operation of the FRP laminate form, after a thorough preparation of substrate 118, a layer of prepared adhesive material 126 is applied on face areas 116 around cavity 108 that will be covered with FRP laminate form. Adhesive material 126 may be spread evenly and smoothly, and ensure that there are no voids, pinholes, bubbles, bumps or other surface irregularities present in the adhesive paste 126 applied to face areas 116. Adequate amount of adhesive material 126 is applied to face areas 116 to ensure complete bonding between the FRP laminate (detailed below) and face areas 116.

Adhesive material (paste) 126 should bind to face areas 116 with sufficient strength that when cured, adhesive paste 126 cannot be mechanically separated from the substrate surface 116 without causing cohesive or other damages to the substrate. That is, mechanical removal of adhesive material 126 will induce or cause cohesive failure on the face areas 116. The cured adhesive material 126 should be solid, generally chemically inert, and impervious to water. Adhesive material 126 should also be sufficiently strong to not peel, crack, wrinkle, shrink or undergo any other deformation due to movements, contractions, expansions or other thermal or mechanical effects that are generally accepted as "normal" for substrate 118. Adhesive material 126 should be sufficiently viscous to allow for it to be conveniently applied as a paste without dripping or sagging down face areas 116 after application. During and after curing, adhesive paste 116 must firmly hold and fixedly maintain in place the FRP laminate form that is mounted over it.

Adhesive material (paste) 126 used in accordance with one or more embodiments of the present invention is a well-known off the shelf product made of high strength polymers, for example, epoxy resin paste adhesive material comprised of thermosetting polymers in non-sag form that include added dry ingredients that increase a viscosity of the epoxy resin to form an epoxy resin paste. Non-limiting, non-exhaustive listing of examples of adhesive material 126 that may be used may include GS 100 epoxy from FRP SOLUTIONS, INC or the like. As with the primer 124, adhesive material 126 is also fully compatible with other materials that are used immediately over or under it.

Figure 6:
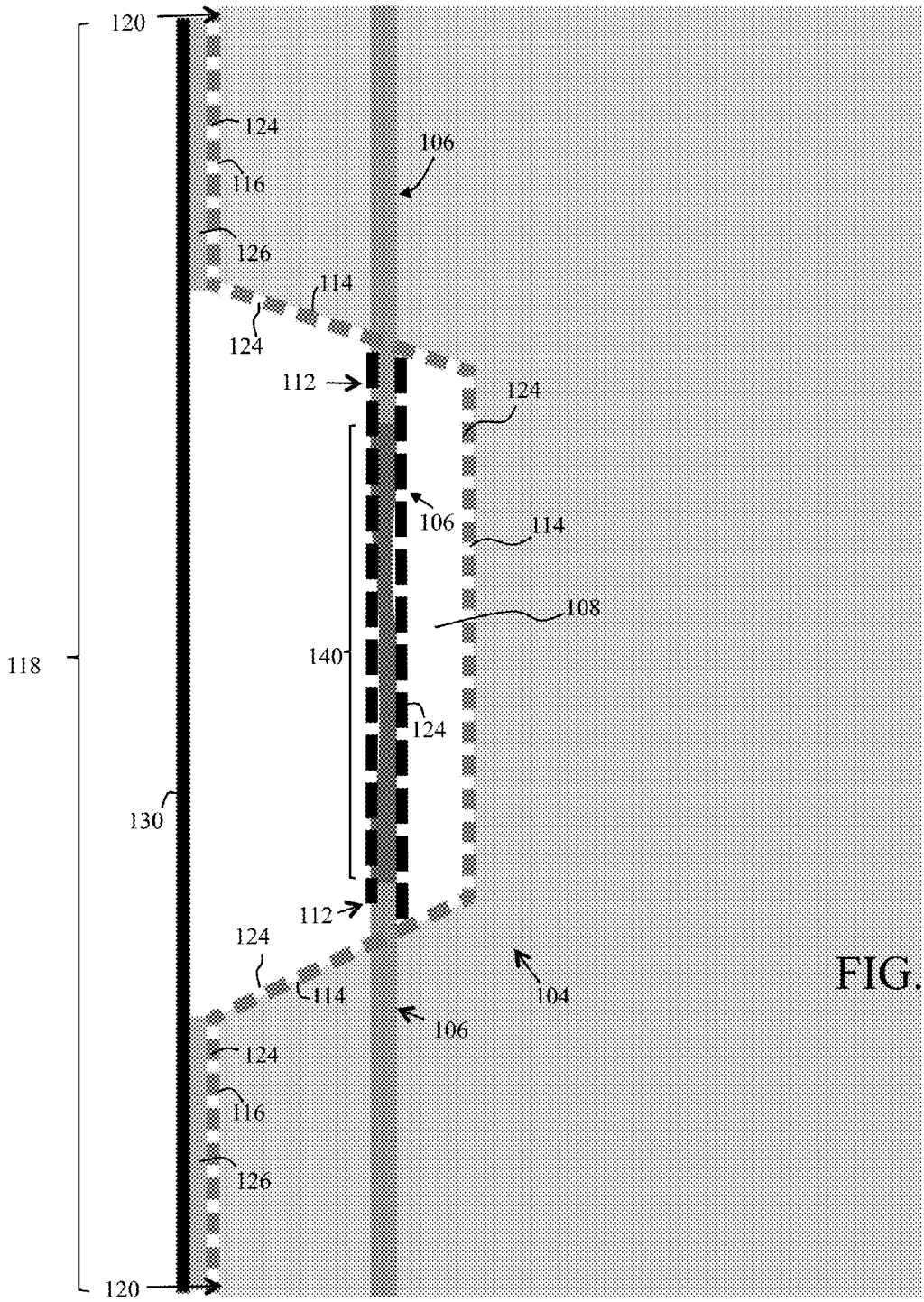
FIG. 6 is a non-limiting, exemplary illustration of substrate covered with tensile member in accordance with one or more embodiments of the present invention.

As best illustrated in FIG. 6, thereafter, and within the working time of the applied adhesive 126, FRP laminate form 130 is mounted on face areas 116 to entirely cover cavity 108. That is, FRP laminate form 130 is placed over face areas 116 covered with adhesive paste 126 within the area markings 120 for application of FRP laminate form 130, with fibers of the FRP 130 oriented in the proper direction. Preferably, fibers are oriented parallel to the direction of reinforcement 106 inside cavity 108. FRP laminate 130 is pressed onto adhesive 126 and face areas 116 using adequate pressure to ensure an intimate contact between FRP laminate 130 and adhesive 126. Using a hard roller, FRP laminate form 130 may be firmly pressed on to adhesive paste 126 to drive the excess adhesive 126 out and create an intimate contact and bond between FRP laminate form 130 and adhesive paste 126. Using a spatula, paint knife or other similar tools, the oozed adhesive 126 from face area 116 may be removed to maintain a neat surface. Care should be taken not to disturb adhesive paste 126 by rotating, twisting, lifting FRP laminate form 130 or other actions that may introduce voids in the bond area or create variations in adhesive paste 126 thickness. In general, the assembled FRP laminate 130 is left intact until adhesive 126 is hardened.

FRP laminate form 130 is a well-known off-the-shelf composite product constructed of fibers of carbon or glass, steel, or other high strength materials, which are impregnated and bonded together with a high strength impregnation polymer resin that is compatible with adhesive 126 and filler (detailed below). The FRP laminate form 130, which constitutes the forming structure as well as the tensile member in accordance with the present invention, may comprise of material (composite material) made of polymer matrix reinforced with fibers. In other words, FRP laminate form 130 is comprised of well-known reinforcing fibers embedded and cured in well-known binder polymer matrix resin using well known methodologies. Non-limiting, non-exhaustive listing of examples of FRP laminate form 130 that may be used may include C-Clad, SC352, etc. from FRP SOLUTIONS, INC., or the like. It should be noted that the binder matrix used is comprised of a polymer matrix with a component thereof being the same material that is used for primer 124. Non-limiting, non-exhaustive listing of examples of a polymer matrix resin used is RN075 epoxy from FRP SOLUTIONS, INC, or the like. Non-limiting, non-exhaustive listing of examples of fibers used for forming an FRP may include FC061 from FRP SOLUTIONS, INC, or the like. FRP and all its constituent components may be obtained from third party manufacturers such as FRP SOLUTIONS, INC. Further details related to FRP laminate form 130 (for example, use of unidirectional laminate forms versus multi-directional laminate forms, use dry versus wet layup, etc.) used is disclosed in U.S. Pat. No. 8,479,468 to Abbasi, the entire disclosure of which is expressly incorporated by reference in its entirety herein. FRP laminate form 130 may be prefabricated in various shapes, dimensions, and thicknesses suitable for most common situations. In general, the number of layers of fiber that are laid over one another (and cannot be physically reduced or removed once fabricated) may determine the thickness of FRP laminate form 130.

Depending on the manufacturing process, the fibers used in constructing the FRP laminate 130 can be either in the form of free strands or woven/bonded fabrics. In the case of using woven/bonded fabrics, a single or multiple layers of fabric may be needed for constructing the FRP laminate 130 to a desired thickness. Also, in the case of using woven/bonded fabrics, only one layer of lighter weight fabric may be placed in a general 90-degree fiber orientation to the main fibers to prevent the cured sheet from splitting and breakage during handling and installation. If required by the design and engineering, the fibers can also be laid in equal amounts in both 0- and 90-degree, or any other amount and directions.

When permissible, the fibers—in fabric form—may be saturated with high strength impregnation polymer to form an uncured and unseeded form of FRP laminate 130, which may be applied to surface 116 by the well-known wet layup method. In the case of using the wet layup method, after cavity 108 and reinforcement 106 are cleared and cleaned as previously stated, face areas 116 surrounding cavity 108 is cleaned and primed with the same high strength impregnation polymer matrix used in saturating the fibers of the FRP in the welt layup method (detailed in the incorporated U.S. Pat. No. 8,479,468 to Abbasi). While the primed face areas 116 are tacky and prior to being hardened, and while the fibers saturated with the high strength impregnation polymer matrix still in the wet state, the saturated fibers of fabric (the uncured form of the FRP laminate 130) may be pressed on face area 116 to form a cover over cavity 108. The saturated fibers of fabric (in the uncured form of the FRP laminate 130) is placed on face areas 116 in a manner that it is bonded completely to face areas 116 all around cavity 108 to the extent determined by design and engineering requirements. In the case that the wet layup application requires using multiple layers of saturated fabrics in the uncured form of the FRP laminate 130, the subsequent layers are applied in the manner that each new layer is in complete and intimate contact and bond with the previous layer. The final assembly is left to cure before proceeding to subsequent operations.

In general, manufactured FRP laminate forms 130 are very hard, smooth and non-porous and hence, it is preferred if they are modified so that their smooth surfaces may adhere to structures and other finishes. Accordingly, in the non-limiting, exemplary instance illustrated in FIG. 6, prior to complete curing of adhesive paste 126, FRP laminate 130 may be coated with an additional layer of the high strength impregnation polymer matrix resin used in its manufacture, non-limiting, non-exhaustive listing of examples of which may include the above mentioned polymer matrix resin RN075 epoxy, or the like. While the additionally applied resin is still liquid, one side of the FRP laminate 130 may be seeded by sprinkling of an adequate amount of clean and dry fine silica aggregate onto it. As indicated above, since the high strength polymer matrix resin applied to the surface of FRP laminate 130 becomes very hard, smooth and non-porous, the seeding process provides a suitable surface for other additional finishes to be applied over the installed system, such as paint, protective coating, plaster, other architectural or protective finishes, etc. The opposite, unseeded side of the cured FRP laminate 130 sheet may be lightly abraded to dull the surface for better bonding with the polymer adhesive paste 126. It should be noted that FRP laminate 130 can be manufactured without being seeded. In such cases, both sides of the FRP laminate 130 can be lightly abraded (either at the manufacturing plant or installation site).

Bonding FRP laminate form 130 with structure 104 using adhesive paste 126 enables the tensile properties of FRP to be transferred to structure 104. Accordingly, FRP laminate form 130 functions as a forming structure for the filler (as detailed below) and adds tensile strength to compensate for loss in tensile strength due to deteriorated reinforcement 106.

In general, reinforcements 106 are positioned near periphery or edges 142 (FIG. 1) of structures 104 and not at the center thereof. Accordingly, an FRP generally compensates for the reinforcement 106 closest thereto. That is, the tensile force that was supposed to have been absorbed and counteracted by particular reinforcement 106 is now absorbed and counteracted by the installed or mounted and fixed FRP. In fact, FRP may completely replace the reinforcement and hence, no further need is required for augmentation of a reinforcement that is fully compromised (as was required by conventional systems). The number and orientations of reinforcement(s) determine FRP thickness and fiber orientations or tensile strength orientation direction of FRP. That is, if two or more reinforcements are used that are oriented crosswise, an FRP may be used that has fibers that are oriented crosswise to mimic tensile strength orientation directions of the original reinforcements.

Upon curing adhesive 126, or curing of all layers of FRP laminate 130 applied by wet layup (as detailed above), filling point mark(s) are placed on FRP laminate form 130 at the intersection of lines marked as detailed above. As best illustrated in FIG. 7A, a hole 132 is made in FRP laminate form 130 (with care not to damage FRP laminate form 130) at the marked filling point 122. The position of the hole 132 is chosen to be at the highest part of cavity 108 when face areas 116 is vertical. If FRP laminate form 130 is in vertical position, hole 132 is drilled at an angle such that drill travels slightly downward towards the inside of cavity 108. The size of hole 132 is chosen to allow introducing filler 134 inside cavity 108 without compromising the strength and integrity of FRP laminate 130. Thereafter, sufficient quantity of filler 134 is prepared and introduced inside cavity 108 through hole 132. Non-limiting, exemplary methods of introducing filler 134 inside cavity 108 may include the use of injection or pumping with manual or automated devices such as hand operated pumps, caulking guns, injection pumps, grout pumps, and other similar devices.

Filler 134 used is waterproof and generally chemical resistant polymer mortar introduced inside cavity 108 directly through a port/hole made in FRP laminate 130 after it is fixed to surface 116, to completely fill up cavity 108 and encapsulate the exposed reinforcement 106, including the corroded portion 110 and partially exposed non-corroded portions 112. This prevents moisture from reaching reinforcement 106, which prevents further corrosion and deterioration of reinforcement 106. As indicated above, getting rid of corrosion is not important because reinforcement 106 is encapsulated within the waterproof filler 134, which prevents further corrosion and also, any loss in tensile strength due to corrosion of reinforcement 106 is more than compensated by FRP laminate form 130. However, waterproof filler 134 must fully cover any corroded portion 110, including a small portion 112 of non-corroded reinforcement 106. The depth of cavity 108 also need not be so deep to enable access for removing rust from reinforcement 106, but must be sufficient to allow filler 134 to fully encapsulate reinforcement 106 from all sides.

It should be noted that filler 134 used fully encapsulates reinforcement 106 and therefore, reinforcement 106 need not be rehabilitate to the level required by conventional processes where the cleaning of all corroded portion must be full to reach the clean steel part of the rebar. The reason for this is because reinforcement 106 will be prevented from further corrosion due to it being encapsulated by the waterproof mortar 134. This also means that there is no need or requirement to apply anti-corrosion to existing rebar. In other words, waterproof filler 134 encapsulating reinforcement 106 would actually protect reinforcement against moisture and hence, future oxidation and corrosion.

Filler 134 is a well-known off-the-shelf polymer-based mortar that is self-leveling and has high compressive and tensile strength properties, with compressive strength thereof at least equal to or greater than that of the substrate 108. Non-limiting, non-exhaustive listing of examples of filler 134 that may be used may include HCM-25R from FRP SOLUTIONS, INC or the like. As with primer 124, adhesive material 126, and FRP constituents, filler 134 is also fully compatible with other materials that are used.

In general, filler 134 used should be able to bind to primed surface 114 with sufficient strength that when cured, filler 134 cannot be mechanically separated from primed surface 114 without causing cohesive or other damages to primed surface 114. That is, mechanically removal of filler 134 will induce or cause cohesive failure on primed surface 114. Cured filler 134 should be solid, chemically inert, and impervious to water. Filler 134 should also be sufficiently strong to not peel, crack, wrinkle, shrink or undergo any other deformation due to movements, contractions, expansions or other thermal or mechanical effects that are generally accepted as "normal" for substrate 118. Filler 134 should be sufficiently viscous to allow for it to be conveniently applied (introduced into cavity 108) and to allow filler 134 to fill every surface (and grooves or cracks) of the cavity 108 and reinforcement 106 (if any is left). In other words, filler 134 should be viscous enough to allow for it to be conveniently placed in cavity 108 and fill all empty spaces in the cavity and bind to all contacting surfaces. It should be noted that filler 134 is fully compatible with other materials that are used and with which it comes to contact. In fact, filler 134 uses the same binder material that is used in making the primer for the cavity 108, FRP laminate forms, and the paste adhesive. the filler has a tensile strength that is greater than the tensile strength of the concrete structure, but less than the tensile strength of FRP.

As illustrated in FIG. 7B, if cavity 108 is to be filled by gravity filling, the tip of the manual or powered grout pump nozzle may be inserted inside cavity 108 thorough hole 132 and filler 134 is pumped until cavity 108 is filled completely, and the filler 134 is in complete, intimate contact with all surfaces 114 inside cavity 108, including reinforcement 106, and FRP laminate form 130. Once cavity 108 is filled, nozzle tip may be removed and hole 132 in FRP laminate form 130 may optionally be plugged with a plastic cap 156. The plug/cap 156 is a well-known off the shelf product, non-limiting examples of which may include rubber, plastic, wood, and other appropriate materials. The cap 156 may be optionally cut off after filler 134 is cured.

As best illustrated in FIG. 7C, if cavity 108 is to be filled by pressure grouting method, conventional injection port 150*a/b* are inserted within respective opening 152*a/b* and the prepared filler 134 is injected inside cavity 108 in well-known method using well known injection equipment, with port 150*b* being the ingress port and 150*a*, the egress port. Ports 150*a/b* are a well-known off the shelf product, non-limiting examples of which may include surface mounted ports, drill ports, weeping type, one way port, check valve types, and others. Once cavity 108 is filled and filler is 134 oozing out of the egress port 150*a*, the injection may be stopped and ports 150*a/b* closed and/or capped to allow filler 134 to cure. Once filler 134 is cured, injection ports 150*a/b* may be cut off and removed without damaging FRP laminate form 130.

It should be noted that as an intermediate operation, as soon as cavity 108 is filled with filler 134, a brief vibration may be applied to the outside surface of FRP laminate 130 to drive out any air entrapped inside filler 134. Vibration also helps the filler 134 to settle, flow, and reach all surfaces 114 inside cavity 108. When filler 134 is completely cured, the plug 132 or the port 150*a/b* may be removed and the hollow area of the hole 132 and 152*a/b* may be patched with an adequate amount of prepared and uncured adhesive 126 or other suitable material and left to cure before applying any finishes as needed. If needed, FRP laminate form 130 or a parts thereof may further be patched (e.g., due to uneven surfaces, voids, etc.) with compatible patching material, and apply finish as required.

As best illustrated in FIG. 8A, in the case of overhead cavities, a venting port 164 is inserted inside the hole 152*b* that is away from the end of the cavity 108 and bored into the FRP laminate from 130 through the point marked by intersection 309*b* (FIG. 3B). The venting port 164 has a tube 166 with sufficient length to reach the deepest point of cavity 108. The tube 166 is placed in cavity 108 so that its tip barely touches surface 114 of cavity 108 thereby creating a minute gap between surface 114 of cavity 108 and the tip of tube 166. The purpose of this port 164 is to prevent air entrapment and ensure that cavity 108 is completely filled with filler 134 as indicated by filler 134 oozing out of this port 166 (as indicated by the egress pointing arrow at the egress port 150*b*). When the cavity 108 is totally filled, both of the ports 150*a/b* are closed and filler 134 is left to cure.

With respect to FIG. 8B in particular, in this non-limiting, exemplary instance, a hole 160 is drilled into structure 104 so as to connect cavity 108 (spalled side) to opposite side surface 162 of structure 104. Hole 160 is drilled either from inside cavity 108 or into surface 162 of structure 104 opposite to cavity 108 opening. Filler 134 is then introduced into cavity 108 via this hole 160 by either gravity feeding or pressure injection by hole 160 from surface 162.

Figure 9A:
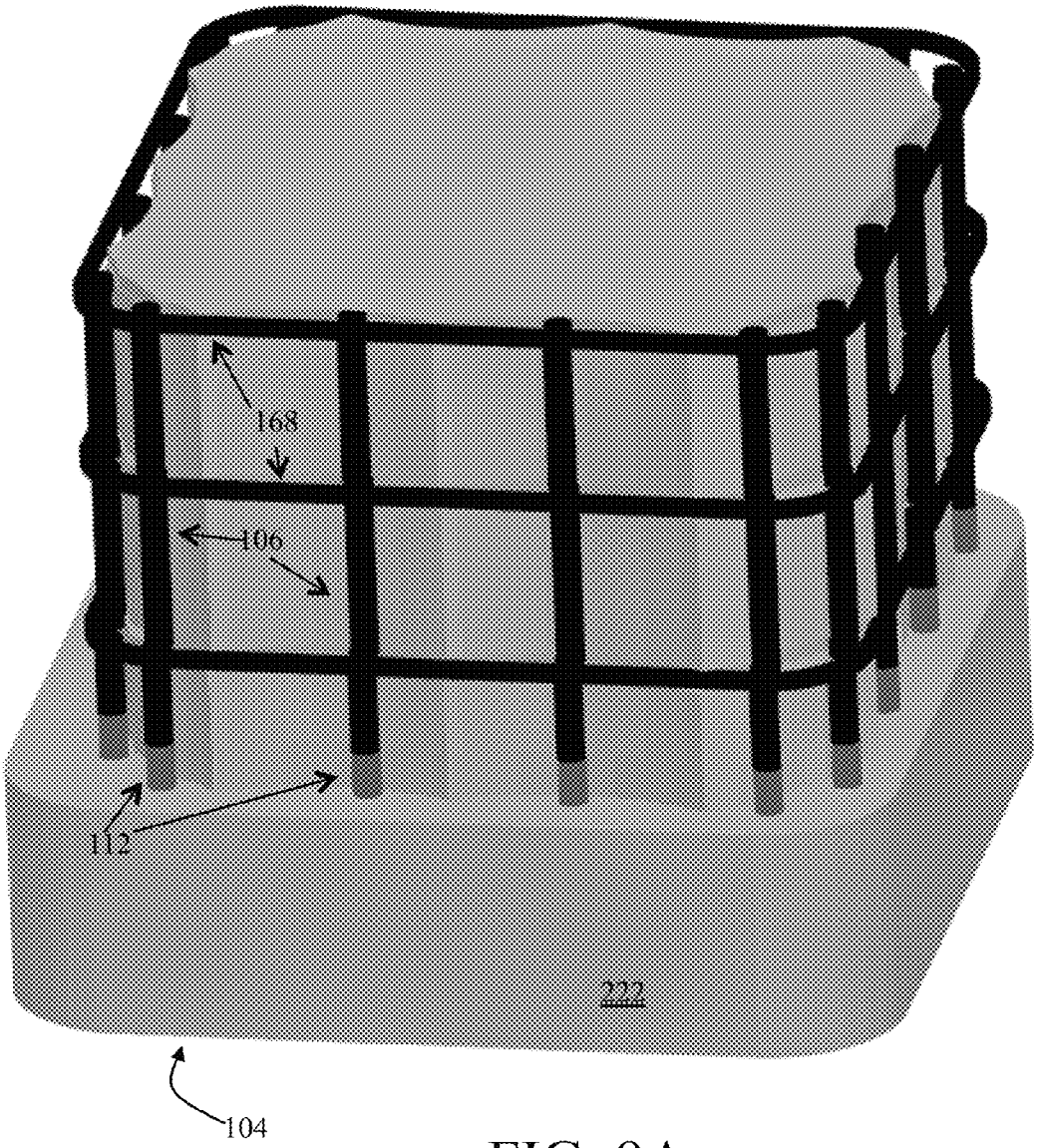
FIGS. 9A to 9C are non-limiting, exemplary illustrations of a method and system for full rehabilitation of reinforced concrete structures that exhibit extensive spalling in accordance with one or more embodiments of the present invention.
Figure 9B:
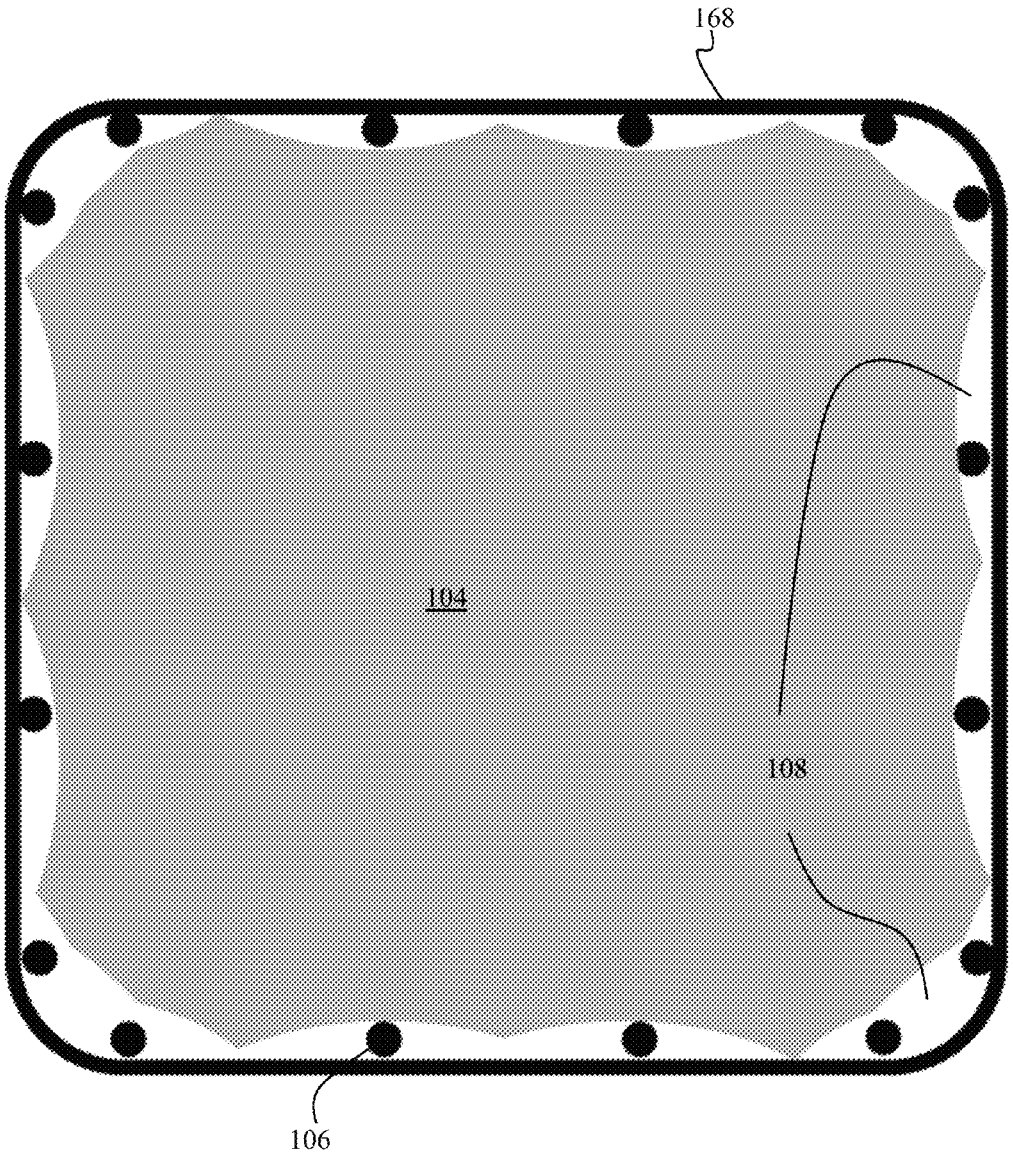
Figure 9C:
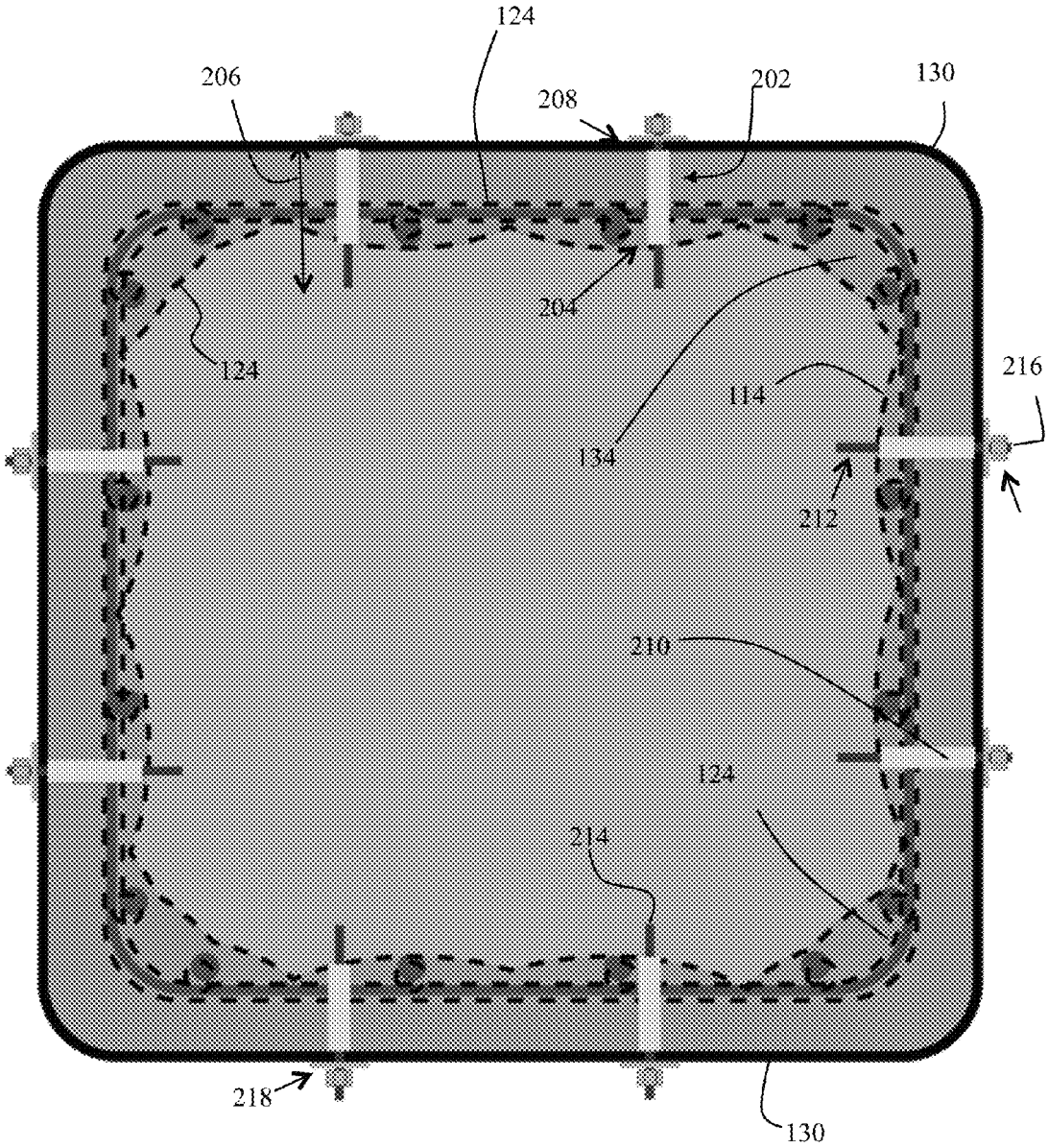

FIGS. 9A to 9C are non-limiting, exemplary illustrations of a method and system for full rehabilitation of reinforced concrete structures that exhibit extensive spalling in accordance with one or more embodiments of the present invention. The method and system illustrated in FIGS. 9A to 9C includes similar corresponding or equivalent components, interconnections, functional, operational, and or cooperative relationships as the method and system that is shown in FIGS. 1 to 8B, and described above. Therefore, for the sake of brevity, clarity, convenience, and to avoid duplication, the general description of FIGS. 9A to 9C will not repeat every corresponding or equivalent component, interconnections, functional, operational, and or cooperative relationships that has already been described above in relation to method and system that is shown in FIGS. 1 to 8B.

As illustrated in FIGS. 9A and 9B, there are instances where the reinforced concrete structure 104 is so severely damaged that the structure 104 does not have a sufficient surface area where it may be constituted as the face area 116 for secure connection of the FRP laminate form as described above. In fact, reinforcements 106 and any confinement rebars (or hoops, stirrups, etc.) 168 are generally exposed. Accordingly, a platform is created that serve the function of the above mentioned face area 116 to connect and secure an FRP laminate form 130 to such severely damaged structures. In this non-limiting, exemplary instance, the FRP laminate form 130 is a bidirectional FRP to supplement or replace bidirectional reinforcement (i.e., reinforcement 106 and confinement bars 168). Therefore, as illustrated in FIG. 9C, a system and a method for rehabilitation and enhancement of structural integrity of a reinforced concrete structure is provided that includes studs 202 (that function support to form a platform to hold FRP laminate 130) with a first end 204 associated with surface 114 of cavity 108. The studs 202 have sufficient height 206 wherein their second end 208 extends out of cavity 108, providing an elevated surface (e.g., platform) that is generally in continuity (or aligned) with original substrate 222 (non-deteriorated, non-spalled) areas at the exterior of cavity 108 to enable connection of a FRP laminate form 130 to second end 208 of studs 202. Finally, the FRP laminate forms 130 are fastened to second end 208 of stud 202 with the remaining processes the same as above. In this non-limiting, exemplary embodiment, the studs 202 are comprised of spacers (or bushings, sleeves, etc.) 210 within which are inserted fasteners (e.g., bolts, FRP anchors, etc.) 212 with a first end 214 of fasteners are secured into surface 114 of cavity 108. FRP laminate form 130 includes connection holes that receive the free ends 216 of the fasteners, with a washer and nut 218 connecting or fixing the FRP laminate form 130 to the spacers 202 via the free ends 216 of the fasteners 212 (if fastener used is a bolt). It should be noted that the first end 214 of the fasteners are secured to surface 114 of cavity 108 by first providing an opening in the surface 114, and doweling the fastener (placing the fastener in hole, and further securing it in the hole with use of adhesive material). Non-limiting example of FRP anchoring is disclosed in U.S. Pat. No. 8,479,468 to Abbasi.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, different types of polymers may be used depending on engineering and design specifications. The thickness, length, width, types, and physical characteristics of FRP laminate 130 may vary according to engineering and design criteria. Non-limiting, non-exhaustive exemplary list of physical characteristics for filler 134 that may vary may include additive fiber type, polymer component, ratios of mix, manufacturer, etc. Filler 134 may be varied in accordance with engineering and designed to meet all specifications. Non-limiting, non-exhaustive exemplary list of physical characteristics for filler 134 that may vary may include the required compressive strength, required tensile strength, modulus of elasticity, use of fiber in the mix. Further, for horizontal applications (FIG. 3B), FRP laminate form 130 is first applied as described for the vertical and overhead applications, thereafter, an opening is made through the FRP laminate form 130 at intersection 313, and filler 134 is filled via the opening until cavity 108 is completely filled in its entirety. Finally, if needed, FRP laminate form 130 or parts thereof may further be patched (e.g., due to uneven surfaces, voids, etc.) with compatible patching material, and apply finish as required. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A method for rehabilitation and enhancement of structural integrity of a reinforced concrete structures, comprising:

detecting a blemished surface of the reinforced concrete structure;

excavating a portion of the reinforced concrete structure at the blemished surface to reach a reinforcement of the reinforced concrete structure, with the excavation forming a cavity on the reinforced concrete structure;

the cavity having a sufficient size wherein an exposure of the reinforcement includes at least a deteriorated portion of the reinforcement and a visible non-deteriorated portion;

preparing the cavity for priming;

priming the prepared cavity;

closing off the primed cavity by a tensile member that is coupled with an exterior surface of the reinforced concrete structure; and encapsulating the exposed reinforcement with a filler, which is cured to a form by the tensile member.

2. The method for rehabilitation and enhancement of structural integrity of a reinforced concrete structures as set forth in claim 1, wherein:

preparing the cavity for priming includes cleaning loose debris.

3. The method for rehabilitation and enhancement of structural integrity of a reinforced concrete structures as set forth in claim 1, wherein:

the tensile member is comprised of composite material made of polymer matrix reinforced with fibers.

4. The method for rehabilitation and enhancement of structural integrity of a reinforced concrete structures as set forth in claim 3, wherein:

the composite material is a Fiber Reinforced Polymer (FRP) that is coupled with exterior surface of the reinforced concrete structure using adhesive material.

5. The method for rehabilitation of a reinforced concrete structures as set forth in claim 4, wherein:

the size of the FRP exceeds the size of the cavity to enable proper coupling of the FRP with the external surface of the reinforced concrete structure, with a width of FRP of sufficient span to cover the cavity and replace strength lost due to corroded reinforcement.

6. The method for rehabilitation and enhancement of structural integrity of a reinforced concrete structures as set forth in claim 1, wherein:

priming the cavity includes application of a primer to a surface of the cavity.

7. The method for rehabilitation and enhancement of structural integrity of a reinforced concrete structures as set forth in claim 6, wherein:

the primer is a polymer.

8. The method for rehabilitation and enhancement of structural integrity of a reinforced concrete structures as set forth in claim 1, further comprising:

seeding a first side of the tensile member to provide a surface for application of additional finish;

abrading a second side of the tensile member to dull a surface of the second side for better bonding with the adhesive material.

9. The method for rehabilitation and enhancement of structural integrity of a reinforced concrete structures as set forth in claim 1, further comprising:

application of vibration to an outer surface of tensile member, which facilitates settling, flow, and reach of filler.

* * * * *